US005150550A

United States Patent [19]

Rionde

[11] Patent Number: 5,150,550

[45] Date of Patent: Sep. 29, 1992

[54] SILO MADE OF SUSPENDED SHEETS

[76] Inventor: Guy Rionde, La Samaritaine, 88800 Vittel, France

[21] Appl. No.: 653,376

[22] Filed: Feb. 11, 1991

[51] Int. Cl.[5] ..... E04H 7/00

[52] U.S. Cl. ..... 52/192; 52/194

[58] Field of Search ..... 52/197, 194, 192, 741, 52/474, 510, 777, 779

[56] References Cited

U.S. PATENT DOCUMENTS

| | | | |
|---|---|---|---|
| 1,243,873 | 10/1917 | Poppenhusen et al. | 52/194 |
| 1,465,745 | 8/1923 | Strong | 52/197 |
| 3,038,566 | 6/1962 | Parsons | 52/194 |
| 3,664,072 | 5/1972 | Lieckfeld | 52/192 |
| 4,881,665 | 11/1989 | McGuire | 52/197 |

*Primary Examiner*—David A. Scherbel
*Assistant Examiner*—Creighton Smith
*Attorney, Agent, or Firm*—Schwartz & Weinrieb

[57] ABSTRACT

Silo for diverse products in bulk, particularly plastic bottles, characterized by a hull (2) constituting its walls, and being formed of thin plates (3) suspended from, or attached to respective horizontal (4) and vertical plates (5) carrying profiles constituting an external framework.

This invention will primarily be of interest to constructors of stockage material for bulk products.

11 Claims, 8 Drawing Sheets

SILO MADE OF SUSPENDED SHEETS

FIELD OF THE INVENTION

The present invention relates generally to silos, and more particularly to a tightly sealed silo, with a suspended hull, particularly a suspended metallic hull.

BACKGROUND OF THE INVENTION

One of the applications of the present invention relates to silos for mass-produced bottles of plastic, or to factories for filling bottles with mineral water or with other drinks.

In the field relating to human food consumption, the greatest precautions with respect to cleanliness and hygiene are required.

In such manufacturing facilities, the plastic bottles, for example, made of polyvinyl chloride, or PVC, are manufactured, to the extent of the amount present in the bottling chain, by a first chain of extruders for quickly mass-producing the containers of plastic material, particularly of PVC, and by an extrusion/blowing process, whereby the containers are able to hold the mineral water distributed in this manner to the consumers.

In view of the high speed of production of these bottles at a high rate, which, however, is frequently interrupted by restocking, it is desirable to provide a restocking stack in several silos.

Inasmuch as this process relates to the field of food, maintenance of the greatest degree of hygienic cleanliness, and a minimum presence of any bacteria is absolutely essential.

Furthermore, for such contents of little commercial value, and reduced process-dwelling time, only silos of great capacity have been shown to be economically desirable.

Additionally, as these products are stocked for only a short time following their manufacture, and as the material used in such bottles is somewhat exposed to the atmosphere, there arises a need for natural or artificial ventilation for discharging such products, primarily chlorified products.

This phase is conventionally called dechlorinization.

In the event of any incorrect or incomplete discharge of these products, the latter remain in the bottles, even in residual amounts, and are passed on their subsequent contents after refilling, leaving a taste which is not very pleasant, and not appreciated by consumers.

For this purpose there already exist aerated silos, formed by a metallic base inclined towards a discharge port, and formed with lateral and upper grilled surfaces in the framework.

Even if the ventilation proceeds quite adequately, at least in the upper part, for complete dechlorinization, in view of access difficulties, neither the conditions required within the processing time, nor those for perfect cleanliness are met.

Furthermore, the shape of the bottles having a square or rectangular cross-section, and disposed in bulk in the silo, as well as the low weight of the bottles, do not aid their discharge movement along an inclined discharge plane.

The attending personnel is obliged to push, or to aid certain bottles descending along the inclined plane, and along the fluid discharge channel by means of repeated pushes on the rear face of the thin plates, and this also applies to any jammed bottles.

Such pushes, which are sometimes violent, cause the base of the silo to deteriorate at a evel of separation of the plates, and deform the latter by impacts in such a manner that they no longer constitute a sufficiently plane sliding surface.

So as to facilitate the use of cleaning and disinfecting agents or equipment, the base of the aforenoted that type of silo is implemented in the form of fixed and removable panels, which can be conveniently removed and displaced, so as to ensure adequate cleaning, and subsequent re-mounting.

In order, however, to avoid such interventions, an automatic interior cleaning system can be provided, for example in the form of turnstiles or of swiveled balls, or any other cleaning assembly operable by fluid pressure, which fulfills the same conditions, and operates in a similar manner.

This assumes silos which are perfectly and tightly sealable, and have a smooth internal surface free of any projections, or other irregularities or material defects.

Furthermore, in order to ensure the required mechanical rigidity, the necessarily large dimensions of such silos lead to the employment of thick, and consequently heavy and expensive plates, which are difficult to emplace.

OBJECT OF THE INVENTION

It is an object of the present invention to remedy such diverse inconveniences by proposing a silo of a new and perfectly tight structure, which is light-weight, smooth and damage-resistant, resulting in an integrated assembly cleanable by compressed fluids.

SUMMARY OF THE INVENTION

For the above-noted purpose, the invention relates to a silo for diverse products in bulk, particularly plastic bottles, characterized by the fact that the metallic hull forming its walls is formed of thin plates suspended in, or hooked to, horizontal and vertical carrier profiles constituting an external framework.

The invention also relates to a corresponding process for constructing a silo, or a closed and tightly sealed enclosure, with its hull being suspended.

Multiple and remarkable advantages result from this mode of construction and fabrication of a silo, and of a silo constructed according to the present invention:

lightweight construction due to the capability of employing thin plates;

notable cost-reduction of the material utilized;

no need for removable panels;

smooth interior due to a continuous weld of all plates;

use of a fully integrated washing and cleaning system;

incorporation of an inclined blowing system for disinfecting and for lifting any bottles which may have been left wedged in the system;

integral tight sealing of the silo;

perfectly smooth interior surface due to the absence of any irregularities, acute angles, or sharp borders which could retain any particles, various stains, or features which could degrade or weaken the bottles by friction;

the concept of silo construction by an exteriorly suspended metallic hull permits utilization of very thin plates without any supplemental rigidizing and/or sealing element, other than welding strands along a superior overlaying sheet;

each sheet is individually suspended on a framework element, thus ensuring the absence of any mechanical strain on the welding joints due to the weight of the hull;

the welding joints are located at the bends of the attachment means on the framework, thus also an improved mechanical stability of the hull is obtained.

BRIEF DESCRIPTION OF THE DRAWINGS

The technical features and other advantages of the invention will be apparent from the following description, which shows a non-limiting example of one mode of implementation if the invention with reference to the annexed drawings, in which.

DETAILED DESCRIPTION OF THE ILLUSTRATED EMBODIMENT

The general inventive idea resides in an implementation of an enclosure stocked with material, particularly of a tightly sealed silo for bottles in bulk, starting with an external framework onto which the plates, particularly thin plates, are hooked, and wherein each plate ensures, in conjunction with an adjacent plate thereof, a tight seal by means of welded strands on the periphery of its borders, of which at least one horizontal joining weld along, or thereat, or near each attachable fold or bind of each plate constitutes attachment means, together with a lateral extension thereof.

More particularly, and with a view to demonstrating the application of the above-discussed inventive idea, the invention will be described in detail hereinafter, and with reference to the different respective annexed figures.

Figure 1:
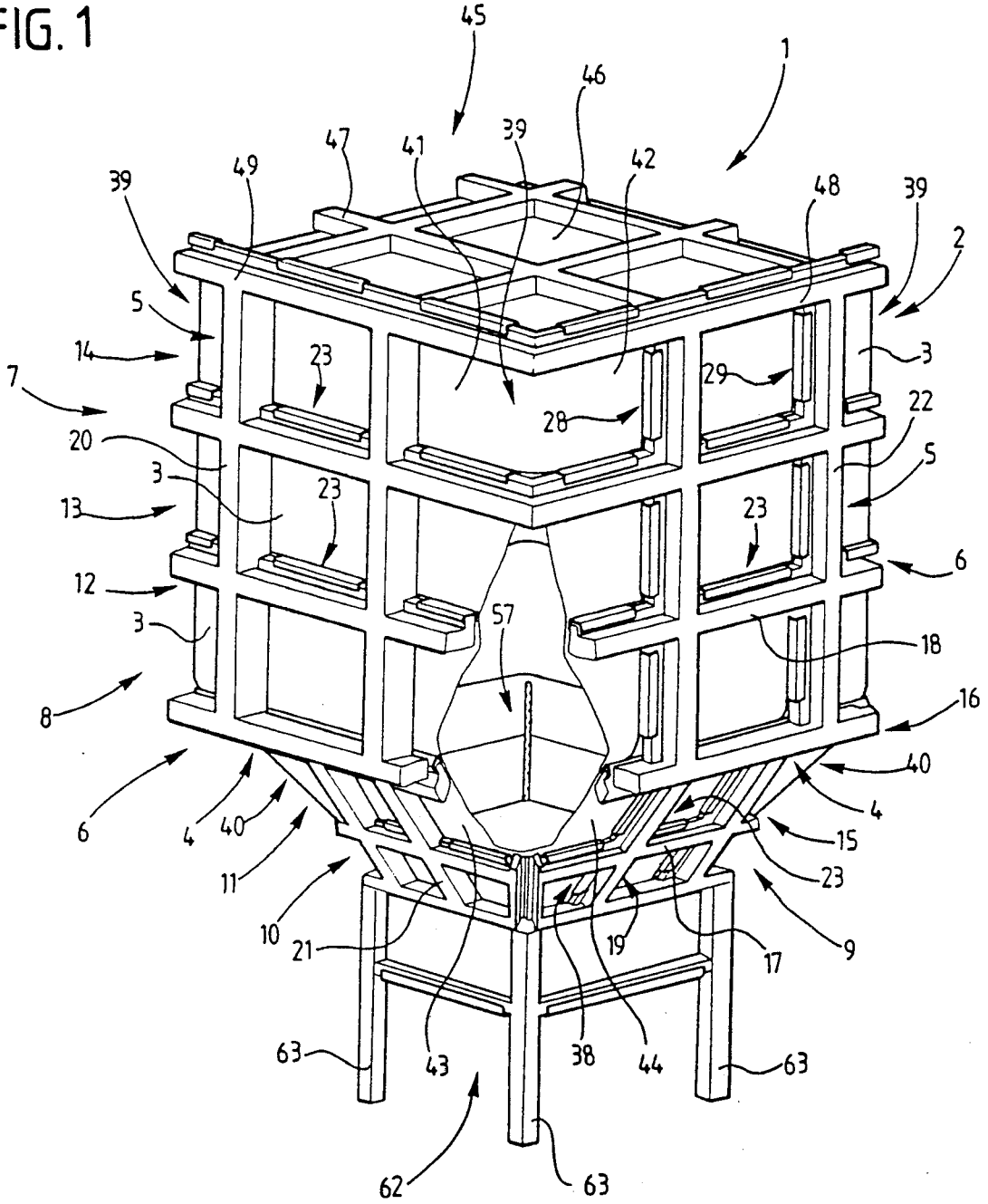
FIG. 1 is a general simplified perspective, partially cut-away view of the assembly, according to the invention.

A silo 1 is constituted by a hull 2, formed by a plurality of plates, such as 3, for example, a thin plate, individually suspended by respective horizontal and upright carriers or struts 4 and 5, from an external, and preferably metallic framework 6, representing the general exterior of the body 7 of the silo 1. As is shown in FIG. 1, the body 7 is constituted by a top enclosure 8 having the general form of a semi-parallelepiped, which is extended towards the bottom by a truncated pyramid 9. The framework therefore takes the general form of a pyramidal parallelepiped having a lattice type structure constituted by a series of horizontal and upright carriers 4 and 5, respectively, which are distributed and stacked along the periphery and along a vertical array in several respective superimposed levels 10–14, so as to be formed with a plurality of polygonal openings defining predetermined areas, respectively. These areas will be seen, as will be shown later, to be either rectangular or quadratic within the upper enclosure 8, or trapezoidal or triangular within the lower enclosure 9.

Conforming to the variant shown, each horizontal perimeter of the truncated pyramid 9, or of the upper enclosure 10, such as 15 and 16, respectively, is formed by series of bars, such as 17, or 18. Similarly, each inclined holder means of the truncated pyramid 9, or upright post of the upper enclosure 8, such as 19 or 20, respectively, is made up of a series of inclined and upright posts, such as 21 and 22, respectively.

Figure 3:
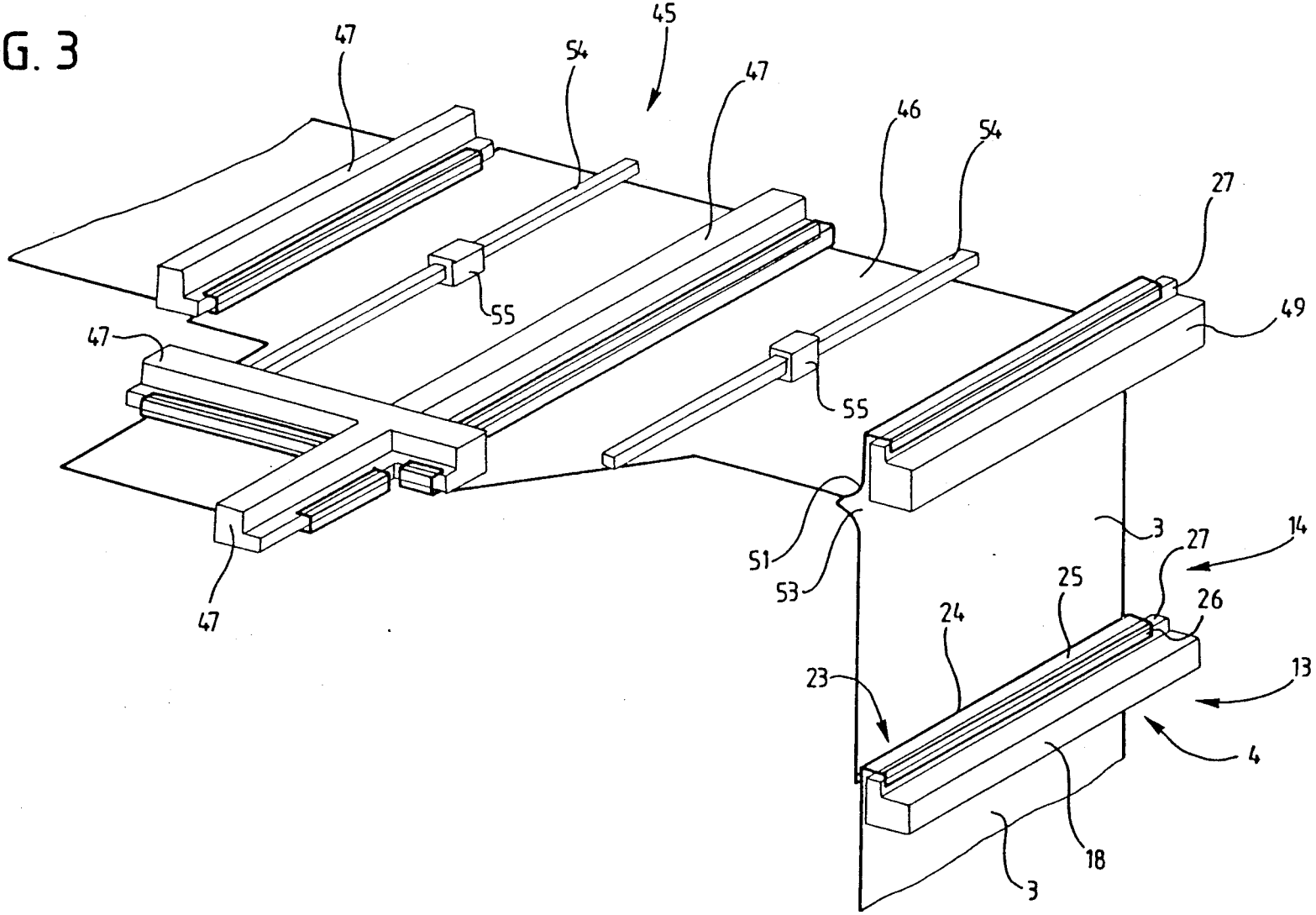
FIG. 3 is a schematic perspective view illustrating the construction of the top portion of the silo.

To the horizontal carrier profiles there are hooked slender plates 3, for example, metallic plates, by means of longitudinal hook-on struts 23, the top portions of which, as can be seen in FIG. 3, carry in turn upper channels 24. These channels are formed by bending the plate-forming material, so that each resulting channel has a U-shaped or double bend cross-section, constituting, in turn, a support bar 25 with lateral flanges 26; this shape, in turn, makes it possible to have wedged or disposed therein a lower adjacent carrier profile, so that each plate, when conforming to the present invention, can be attached in this manner to a corresponding carrier profile.

The plates 3 are therefore either directly connected to the adjacent carrier profile, or may be connected, alternately, to an auxiliary carrier profile 27.

According to an illustrated variant, each of the plates may also be attached to at least one hook-on strut, such as 28, which is in turn affixed to a corresponding vertical attachment profile, such as 30.

Figure 5:
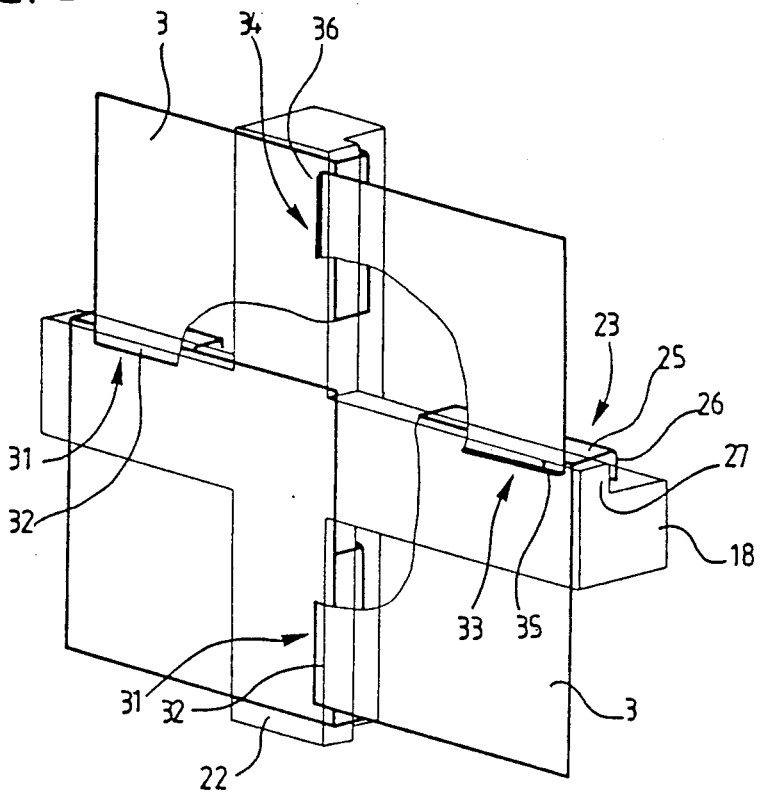
FIGS. 5 and 6 are simplified schematic perspective views illustrating respectively a front view, and a rear view of the vertical and horizontal cross-structure of the framework of the silo.
Figure 6:
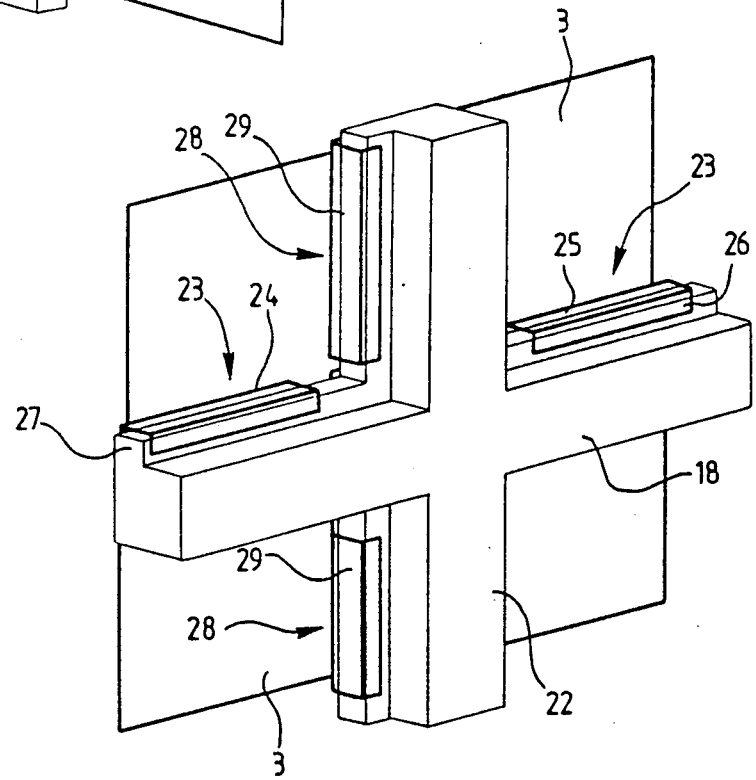
Figure 7:
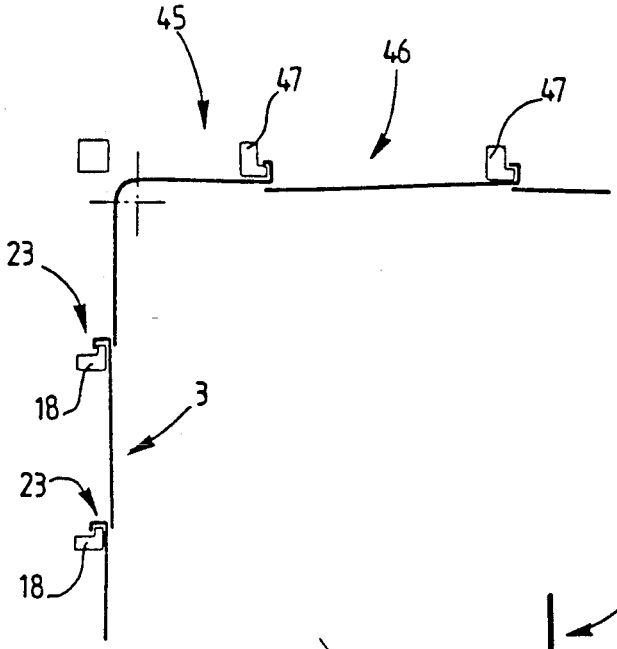
FIG. 7 is a partial schematic view in vertical cross-section of the cylindrical top portion of the silo.

The plates have such dimensions that they overlap one another on the peripheral cover bands, such as 31, which are of minimal width 32, which width is sufficient to realize the sealing tightness and cohesion of the assembly by horizontal welding strands, such as 33, and vertical welding strands, such as 34 (FIG. 5). These peripheral bands are made up of horizontal and vertical hands 35 and 36, respectively.

Figure 8:
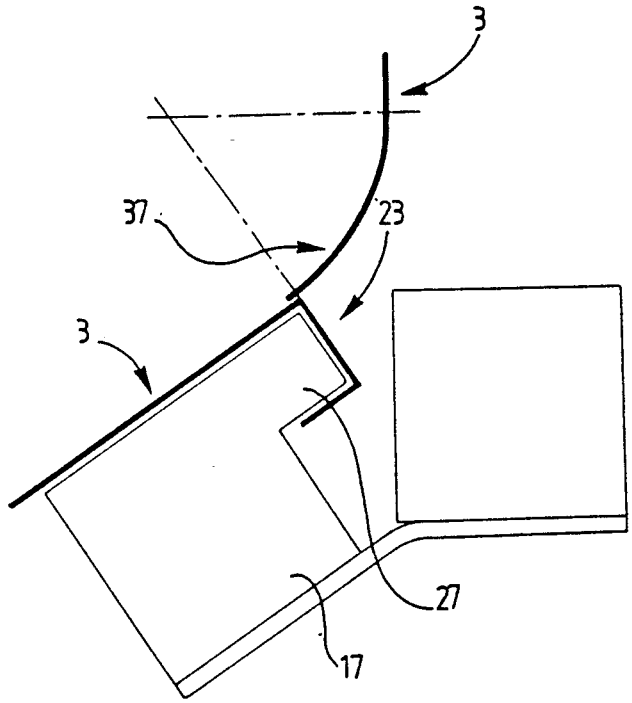
FIG. 8 is a schematic vertical cross-section showing the joining section between the cylindrical and conical portions of the silo.

It is important to state that the horizontal and vertical overlaps take place with respect to the horizontal and vertical carrier sections of the framework only at the bend of each board carrying hook-on means of a type so as to facilitate welding and mechanical adhesion. The overlaps also take place in the curved regions, where a change of shape and of the manner of attachment take place, which occur at the base of the vertical enclosure at the level of the junction with the truncated pyramid 9. In that joining region the upper carrier profiles of the truncated pyramid 9, and the lower carrier profiles of the upper enclosure 8 are adjacent, and the plates of the first level of the upper enclosure are provided with a lower curved and rounded overlap board 37 so as to both ensure continuity and to also be being also tangent to the inclined plane of the truncated pyramid. (FIG. 8).

As has already been indicated, the lower part of the truncated pyramid or cone 9 has a shape which converges towards the bottom, and is implemented in the same fashion by attachment and joining by juxtaposition or overlap of identical plates 3 on the profiles of the framework, with the aid of a longitudinal upper attachment strut 23 thereof As in the previous case, according to a variant of the invention, the plates forming the hull of the truncated pyramid are further laterally wedged or otherwise immobilized by supplemental lateral struts 38.

This lower part of a generally pyramidical form is implemented along the same general principles of construction, which permits, in turn, the utilization of very thin plates.

Also applicable for the upper enclosure 8, as well as for the truncated pyramid 9, is the fact that inclined plates 39 and 40 are needed. They are disposed in pairs of planes 41 and 42, and 43 and 44, which are respectively perpendicular to one another.

For reasons of rigidity and uniformity, in each plane there are found respective longitudinal upper and lateral attachment struts.

Figure 2:
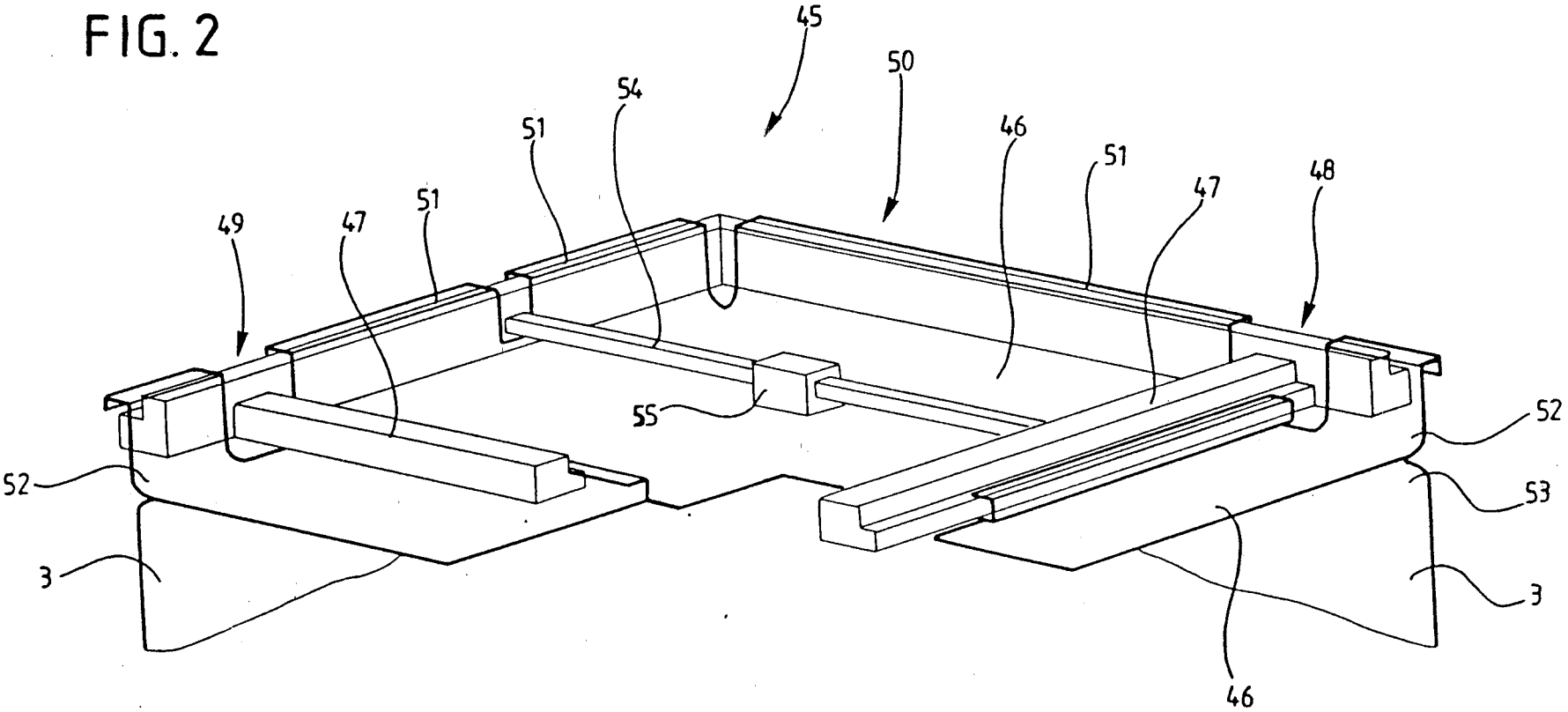
FIG. 2 is a perspective view illustrating the peripheral cover of the top portion of the silo.

Referring now to FIG. 2, the top portion of the silo 1 is closed by a cover 45, constructed in the same fashion by the thin plates of the cover 46, which are in a horizontal position, and hooked on to the carrier profiles 47.

Distinguished are the border carrier profiles 48 and 49, to which are then hooked on or attached thin plates adjacent to the perimeter of the border 50. These plates terminate in raised channels 51 obtained by a U-shaped bend 52 rounded-off at its edges.

The top extremity of the thin plates of the last level of the lateral walls of the enclosure 8 is also formed with a curved and rounded cover plate 53, so as to ensure tangent continuity with the thin plates of the cover 45. These boards are welded, in order to ensure the required sealing tightness.

The carrier profiles of the cover 47 divide the upper space into four parts, to which there are hooked the thin plates of the cover 46, so as to constitute its base.

There are also provided rigidizing struts, such as 54, each carrying a sustaining member 55, to which, in turn, each of the cover plates 46 is rigidly attached in a supplementary fashion. In view of their horizontal position, and their feeble thickness, these thin plates require additional support, which is provided by each stud of the sustaining member 55.

For the needs of the lower, convergent part in a lower region of the silo, certain thin plates are shaped in a generally trapezoidal or triangular form.

In that region there is also provided an injection assembly 56 for blowing thereinto an inert gas, or sterilized air so as to not only ensure cooling by ventilation, degassing, aeration, conversion of water into mist, and pulverization of cleaning and disinfecting agents, but also to disengage certain bottles by jets of compressed air, which bottles might have become stuck.

Figure 4:
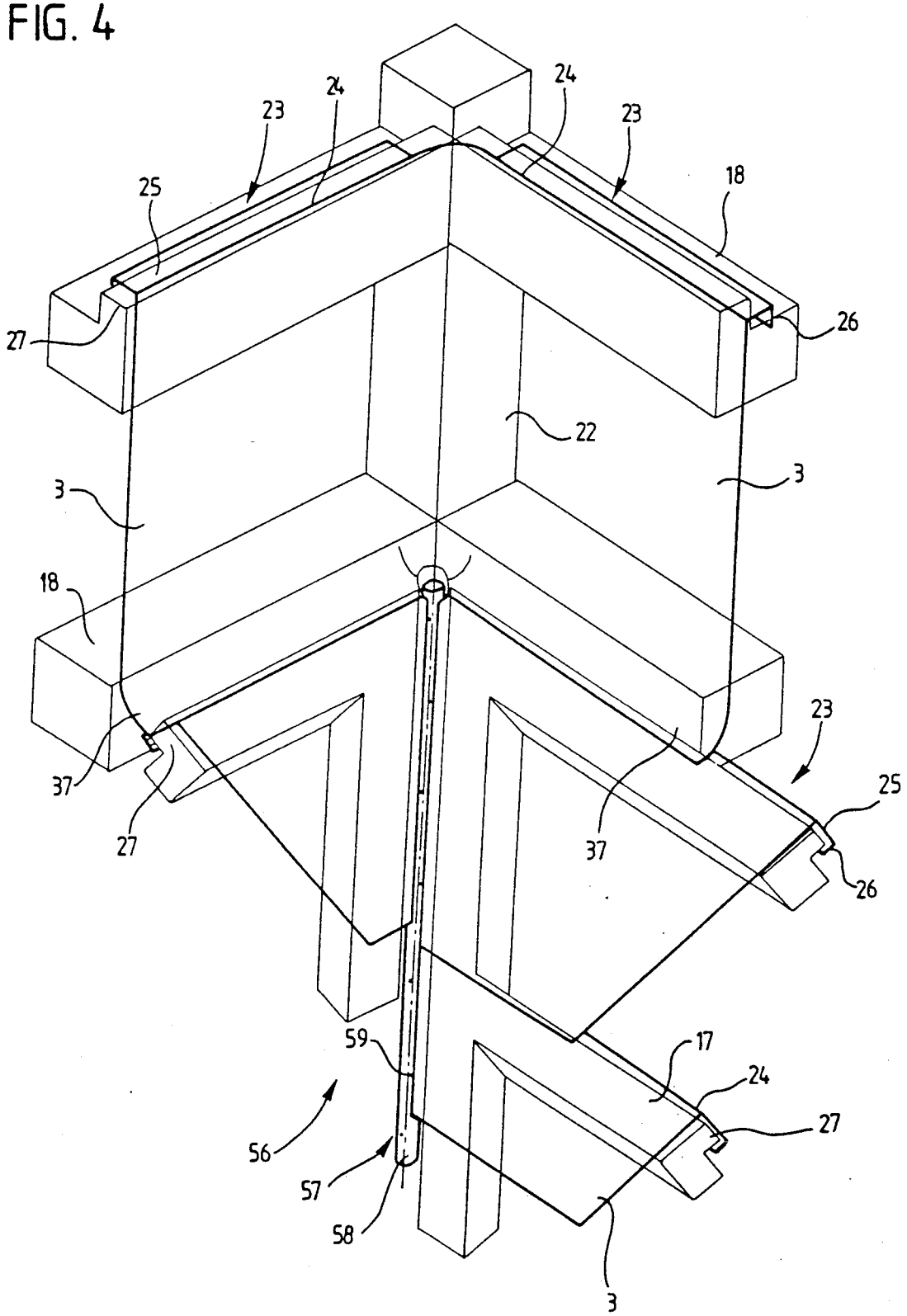
FIG. 4 is a simplified perspective view illustrating the general interior construction of the silo.
Figure 9:
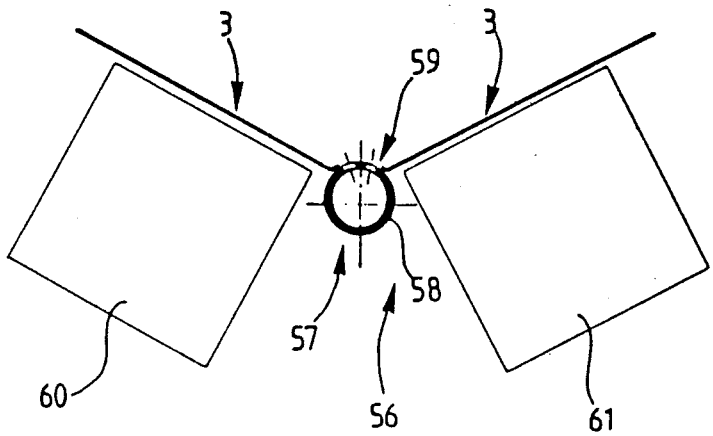
FIG. 9 is a schematic view in vertical section of the truncated pyramidal portion of the silo.

This assembly is formed, for example, by a plurality of inclined and converging ramps, such as 57 as seen in FIG. 4. These are preferably constituted by tubes 58, provided with orifices 59 disposed along inclined stays at the junction of the inclined planes forming the truncated pyramid. Additional reinforcing blocks 60 and 61 improve, in case of need, the mechanical rigidity. (FIGS. 4 & 9).

An upper trapdoor permits refilling of the silo, and a lower trapdoor permits the discharge of (non-illustrated) stocked products.

A support 62 with four legs, such as 63, supports the entire silo assembly.

Figure 10:
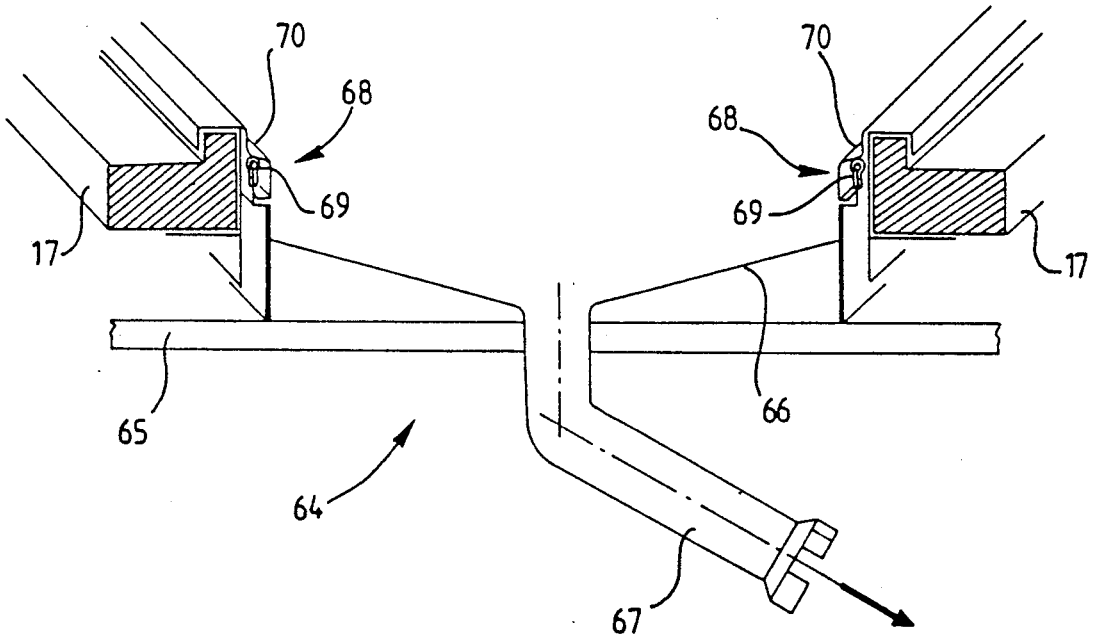
FIG. 10 is a mixed schematic composite view showing the general configuration of the sub-assembly for discharging the spent cleaning fluid from the interior of the silo.
Figure 11:
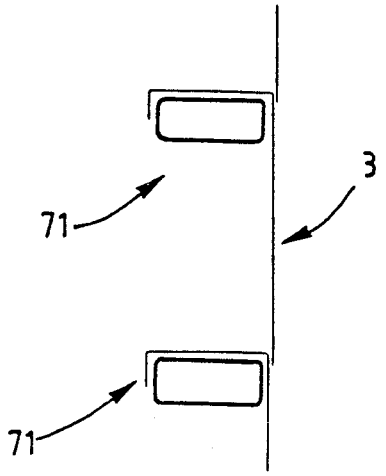
FIGS. 11–15 are transverse sections illustrating diverse anchoring structures for the wall of the enclosure suspended from the framework.
Figure 14:
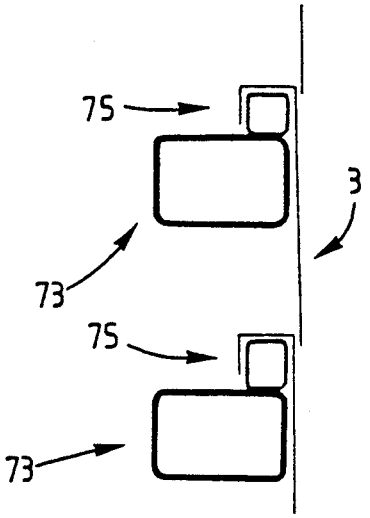
Figure 13:
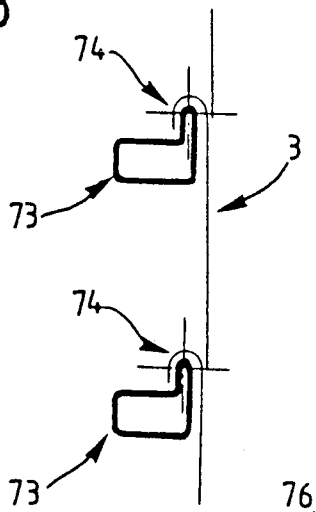
Figure 12:
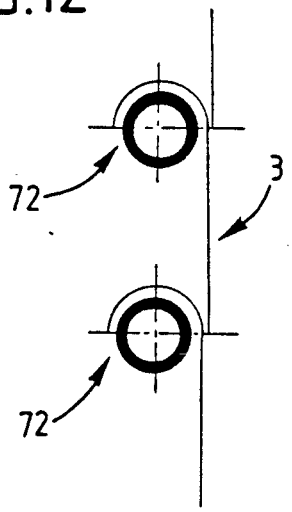

The silo carries on its lower part an assembly 64 for collection of spent cleaning water, shown schematically in FIG. 10. The base of the assembly is formed by an arm 65, which is made up of a lower cone 66, and an output port which communicates with a discharge conduit 67.

The lateral wall of the cone is connected to the base of the truncated pyramid by a junction formed by attachment means 68, provided with a clip 69, and is constituted by a lower strut 70 releasably connected to the thin plate of the lowermost portion of the truncated pyramid Diverse carrier profiles can be utilized. By way of example, five versions are shown in FIGS. 11–15.

Simple profiles having a rectangular cross-section 71 (FIG. 11), a circular cross-section (FIG. 12), a section with an upward embossment constituting an attachment shoulder by way of a supplementary strut 74 (FIG. 13), or a profile with an additional strut 75 attached thereto (FIG. 14), are possible.

Figure 15:
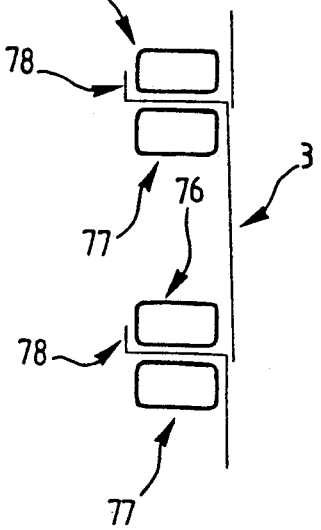

There are also available double profiles, such as 76, 77, for which an overhang of the plate 3 pointing upwardly represents a lodgment, so that the plate 3 is sandwiched between the two superimposed profile elements as shown in FIG. 15.

Furthermore, the nature and construction of the plates, be it by their material, or their thickness, and their general shape matter little, as long as their firm interconnection and attachment, respectively, are possible.

The invention also relates to a method of constructing the sealingly tight silo.

This process resides in the construction over the entire surface of the body of the silo of an external framework of profiles having a plurality of horizontal perimeter lines at different respective levels formed by a series of profiles. These perimeter lines are implemented at intervals by vertical struts. The process subsequently calls for each upper board of each thin plate to conform in format with one attachment strut thereabove for each profile of the framework, and above at least one lateral strut. These struts are formed, for example, by a U-shaped double bend, permitting a wedge-type attachment.

The process finally calls for rendering the silo tightly sealed by welding the lower borders of the thin plates at, or near, the occurrence of the first bend, thus forming an attachment strut disposed immediately therebelow, and ensuring a completely tight seal by welding the superimposed lateral boards or channels together, and so creating a minimal cover band.

The upper cover of the silo is implemented in the same manner as the lower truncated pyramid.

The joining zones between the vertical surface and the truncated pyramid, as well as with the base of the cover are implemented by means of curved cover boards.

The invention has been described hereinabove in detail. It will be understood, however, that diverse simple modifications, attachments, direct variants, and substitution by equivalent means are covered by the scope of the appended claims.

I claim:

1. A silo, comprising:

a framework comprising a plurality of vertically spaced horizontal support members, and a plurality of horizontally spaced vertical support members connected to said horizontal support members so as to define with said horizontal support members a lattice-type framework comprising windows having perimeter portions defined by said horizontal and vertical support members; and a plurality of plates suspendingly supported directly from said horizontal support members so as to cove said windows and fixedly connected to each other so as to define a closed interior surface for said silo.

2. A silo as set forth in claim 1, wherein:

an upper portion of said framework has a configuration which substantially comprises that of a parallelepiped; and a lower portion of said framework has a configuration which substantially comprises that of a truncated pyramid.

3. A silo as set forth in claim 1, wherein:

said plurality of plates each comprise a metallic plate.

4. A silo as set forth in claim 1, wherein:

each of said horizontal support members comprises a support bar portion; and each of said plurality of plates comprises a substantially U-shaped strut portion provided within an upper region of each one of said plurality of plates for suspendingly engaging said horizontal support bar portions of said horizontal support members whereby said plurality of plates are respectively suspendingly supported from said horizontal support members.

5. A silo as set forth in claim 4, wherein:

each of said U-shaped strut portions of said plurality of plates comprises a double-bend portion integrally formed within an uppermost portion of each one of said plates.

6. A silo as set forth in claim 2, further comprising:

gas injection means for injecting a gaseous medium into an interior portion of said silo for any one of ventilation, aeration, sterilization, disinfection, and degasification purposes.

7. A silo as set forth in claim 6, wherein said gas injection means comprises:

tubular conduit means fixedly disposed within a corner junction of said silo as defined between adjacent sidewalls of said framework and extending vertically upwardly within said corner junction of said silo; and a plurality of gas discharge apertures defined within sidewall portions of said tubular conduit means for discharging said gaseous medium into said interior portion of said silo.

8. A silo as set forth in claim 7, wherein:

said tubular conduit means are disposed within corner portions of said truncated pyramid lower portion of said framework.

9. A silo as set forth in claim 2, further comprising:

a plurality of support legs fixedly secured to bottom portions of said truncated pyramid lower portion of said framework for supporting said silo.

10. A silo as set forth in claim 2, further comprising:

water discharge means fixedly connected to said lower truncated pyramid portion of said framework for discharging spent cleaning water from an interior portion of said silo.

11. A silo as set forth in claim 10 wherein said water discharge means comprises:

a trough section fixedly connected to said lower truncated pyramid portion of said framework;

a discharge port defined within a central portion of said trough section; and a discharge conduit fluidically connected to said discharge port.

* * * * *